US005896803A

United States Patent [19]

Sugawara et al.

[11] Patent Number: 5,896,803

[45] Date of Patent: Apr. 27, 1999

[54] SHOE FOR SWASH PLATE COMPRESSOR

[75] Inventors: Takehiro Sugawara; Masayuki Nagase; Jun Yamazaki; Kou Yonesaka, all of Kashiwazaki, Japan

[73] Assignee: Riken Corporation, Tokyo, Japan

[21] Appl. No.: 08/946,625

[22] Filed: Oct. 7, 1997

[30] Foreign Application Priority Data

Jul. 8, 1997 [JP] Japan ..... 9-182577

[51] Int. Cl.[6] ..... F01B 3/00

[52] U.S. Cl. ..... 92/12.2; 92/57; 92/71; 417/269

[58] Field of Search ..... 92/12.2, 57, 71; 417/289

[56] References Cited

U.S. PATENT DOCUMENTS

| | | | |
|---|---|---|---|
| 4,662,267 | 5/1987 | Kaku et al. | 417/269 X |
| 4,683,803 | 8/1987 | Miller et al. | 417/269 X |
| 4,683,804 | 8/1987 | Futamura et al. | 417/269 X |
| 5,062,773 | 11/1991 | Kawai et al. | 417/269 |
| 5,382,139 | 1/1995 | Kawaguchi et al. | 417/269 |
| 5,483,867 | 1/1996 | Ikeda et al. | 417/269 X |

*Primary Examiner*—Hoang Nguyen
*Attorney, Agent, or Firm*—Bachman & LaPointe, P.C.

[57] ABSTRACT

In a shoe 5 for a swash plate compressor, the conical tapered surface 13 is formed between the spherical surface 10 and the rounded edge 14 to converge toward the spherical surface 10 inside an imaginary spherical surface 15 including the spherical surface 10. The conical tapered surface 13 forms a relatively large arcuate gap 23 between the hemispherical concavity 7 and the conical tapered surface 13. The arcuate gap 23 serves to reserve necessary amount of lubricant oil which may be supplied to sliding portions between the spherical surface 10 of the convex surface 11 and hemispherical concavity 7 of the piston 2. In addition, upon manufacture of the shoe 5, it can easily be removed from a metallic mold 52 due to existence of the arcuate gap 23 which prevents tight fit of the shoe 5 in the mold 52.

11 Claims, 7 Drawing Sheets

SHOE FOR SWASH PLATE COMPRESSOR

FIELD OF THE INVENTION

This invention relates to a shoe positioned between a piston and a swash plate of a swash plate compressor to convert rotational motion of the swash plate into reciprocal motion of the piston.

PRIOR ART

As shown in FIG. 10, a swash plate compressor comprises a piston 2 disposed within a cylinder block 1, a swash plate 4 secured to a shaft 3 for integral rotation, a hemispherical shoe 30 interposed between the piston 2 and swash plate 4. When the shaft 3 is rotated by a driving source not shown, the swash plate 4 is rotated together so that rotational motion of the swash plate 4 is converted into reciprocal motion of the piston 2. Thereby, displacement of the piston 2 can introduce media such as cooling refrigerant gas into cylinders 6 from openings of a valve seat 9, compress and discharge it from the cylinders 6.

For example, Japanese Utility Model Publication No. 61-43981 discloses a shoe for a swash plate compressor as shown in FIG. 11 wherein each of the shoes 30 comprises a spherical surface 31 received within a hemispherical concavity 7 of each piston 2 for spherical motion, and a flat surface 32 in contact with a corresponding flat surface 8 of the swash plate 4 for plane motion. When the shaft 3 is rotated, the flat surface 32 of each shoe 30 is in sliding contact with the flat surface 8 of the swash plate 4 so that the flat surface 32 serves as a slider on the flat surface 8 at a high rate. Simultaneously, the spherical surface 31 of each shoe 30 is in sliding contact with the hemispherical concavity 7 of the piston 2 so that the spherical surface 31 operates as a universal bearing. In this way, the shoe 30 performs two functions of slider and universal bearing to convert rotational motion of the shaft 3 into reciprocal motion of the pistons 2. During a compression stroke of each piston 2, an extremely high pressure is loaded on each shoe 30 between the piston 2 and swash plate 4 with relative sliding velocity over 20 meters per a second between the flat surface 32 of the shoe 30 and the flat surface 8 of the swash plate 4 so that the shoe 30 must be operated under such very severe environment.

On the other hand, dissolved in refrigerant media is lubricant which is circulated through frictional parts of the compressor. In fact, the lubricant is diluted by the refrigerant media and then supplied to the frictional parts under a sprayed condition. Accordingly, continuous operation of the compressor under the high load may cause erosion on the hemispherical concavity 7 of the piston 2 due to abrasion by the shoe 30 to thereby expand clearance between the piston 2 and shoe 30. Such expanded clearance provides backlash which results in amplification of vibration and noise and at the worst may damage or destroy the compressor.

In this view, FIG. 12 indicates a shoe as shown in Japanese Patent Publication No. 3-51912. The upper portion of the shoe 40 comprises a basic spherical surface 41 of its radius of curvature substantially equal to that of the hemispherical concavity 7 of the piston 2, and a swerving spherical surface 43 receded toward a central point of the shoe 40 from the basic spherical surface 41 so that a gap 44 is formed between the hemispherical concavity 7 of the piston 2 and swerving spherical surface 43 of the shoe 40 when the swash plate 4 is rotated. The basic spherical surface 41 is effective to prevent increase of bearing stress, and the gap 44 serves to reserve lubricating oil which prevents abrasion on the hemispherical concavity 7 of the piston 2 during sliding motion of the shoe 40.

Prior art compressors utilize refrigerant media of chlorofluorocharbon called as "flon" which includes chlorine in its molecular structure as an extreme-pressure additive for good sliding property. However, there is a likelihood that the "flon" including chlorine destroys ozonosphere, and therefore it should be prohibited from being used in view of environmental protection. Recently, new flon refrigerant media have been developed wherein the molecular structure includes hydrogen in lieu of chlorine, however, the hydrogen does not serve as an extreme-pressure additive unlike chlorine so that sliding parts and shoes are subjected to a harder sliding condition.

Several kinds of new type flon including hydrogen in lieu of chlorine have been proposed to provide more efficient refrigerant media at present. Simultaneously, bearing stress is gradually increased because pressure loaded on sliding surfaces becomes higher upon compression of refrigerant media. Therefore, the compressor tends to produce adhesion at a sliding contact between the flat surface of the shoe and swash plate. Also, sliding property should be improved to increase efficiency of the compressor in view of energy conservation and resources saving.

To overcome the foregoing defects in prior art compressors, Japanese Patent Publication No. 63-27554 demonstrates a shoe with a flat surface which is formed into a curved convex surface of extremely large radius of curvature to have its summit at the center thereof. This shoe, however, is disadvantageous in that it tends to produce seizure under the severe sliding condition because the summit formed at the center of the flat surface generates higher bearing pressure due to the point contact with the piston.

In another aspect, the swerving spherical surface 43 of the shoe 40 shown in FIG. 12 raises a new problem that cannot reserve enough amount of lubricant oil in the gap 44 because, as shown in FIG. 13, it is formed into a thin triangle section between the hemispherical concavity 7 of the piston 2 and swerving spherical surface 43 of the shoe 40. Due to the insufficient amount of lubricant oil reserved in the gap 44, smooth sliding contact cannot be made between the hemispherical concavity 7 of the piston 2 and the basic spherical surface 41 of the shoe 40. Also, in manufacture by a precision cold forging method, the shoe 40 cannot easily be removed from a mold because of the swerving spherical surface 43 and the basic spherical surface 41 both of which have their large spherical areas in contact to an inner surface of a mold recess, thus resulting in increase of frictional force upon removal of the shoe from the mold. Accordingly, the shoe 40 tends to be irrevocably deformed or damaged when it is removed from the mold after forged.

Also, the arrangement of the piston, swash plate and shoe define clearance which should be strictly controlled for smooth operation of the swash plate compressor. To this end, it is a usual way to prepare a number of shoes of height differences ranked on the order of a few microns, and then to select a shoe of suitable height and attach same to a compressor. This method, however, requires a plurality of molds to manufacture the shoes in different heights. In addition, this method requires plural kinds of materials to be forged into shoes of different heights in accordance with different volumes of mold recesses so that the shoes are manufactured at high cost in preparing plural kinds of materials and molds. In fact, these shoes cannot visually be distinguished from each other because of very slight difference in volume between shoes so that it is impossible to visually select a suitable shoe of shoes made of different materials. If the material is forged with its larger volume than that of recess volume in the mold, the produced shoe has harmful burr or flash, or in extreme cases, the mold is damaged. Adversely, if the material is forged with its smaller volume than that of recess volume in the mold, the resulted shoe does not have sufficient surface areas in contact to the hemispherical concavity 7 of the piston 2 and flat surface 8 of the swash plate 4.

To prevent incorrect insertion of the material to be forged into an irrelevant mold, it is possible to adopt a method for measuring weight of each shoe for sorting because this method is time-consuming in comparison with the forging method. Also, to exactly measure weight of each shoe, a measuring apparatus requires frequent troublesome calibration. Weight of shoes should be measured in a place sufficiently away from a forging machine to avoid dynamic influence by the forging machine such as vibration on the measuring process for accurate weight measurement.

Accordingly, an object of the present invention is to provide a shoe for a swash plate compressor capable of effectively supplying lubricating oil to sliding surfaces of a shoe during operation of the compressor.

Another object of the present invention is to provide a shoe for a swash plate compressor capable of preventing adhesion of the shoe with lubricating oil having its low coefficient of dynamic friction.

A further object of the instant invention is to provide a shoe for a swash plate compressor well operable for a long period of time with easy maintenance.

A still further object of the invention is to provide a shoe for a swash plate compressor having its long duration.

A still another object of the invention is to provide a shoe for a swash plate compressor which may be manufactured at low cost.

SUMMARY OF THE INVENTION

The shoe for a swash plate compressor according to the present invention, includes a convex surface (11) in contact to a hemispherical concavity (7) formed on a piston (2) of the swash plate compressor, and a bottom surface (12) in sliding contact to a surface of a swash plate (4) of the swash plate compressor to convert rotational motion of the swash plate (4) into reciprocal motion of the piston (2). The convex surface (11) comprises at least a conical tapered surface (13, 18) and a spherical surface (10) which extends from a top of the convex surface (11) into a rounded edge (14) which is formed at a boundary between the convex surface (11) and bottom surface (12). The conical tapered surface (13, 18) is formed between the spherical surface (10) and the rounded edge (14) to converge toward the spherical surface (10) inside an imaginary spherical surface (15) including the spherical surface (10) in order to form a relatively large arcuate gap (23) between the hemispherical concavity (7) and the conical tapered surface (13, 18). The arcuate gap (23) serves to reserve necessary amount of lubricant oil which may be supplied to sliding portions between the spherical surface (10) of the convex surface (11) and hemispherical concavity (7) of the piston (2). In addition, upon manufacture of the shoe (5), it can easily be removed from a metallic mold (51, 52) due to existence of the arcuate gap (23) which prevents tight fit of the shoe (5) in the mold (51, 52).

In an embodiment of the present invention, two or more of the conical tapered surface (13, 18) of different conic angles may be formed between the convex surface (11) and the rounded edge (14). The convex surface (11) may be provided with a flat surface (19) or a hole (25). The spherical surface (10) formed on the convex surface (11) has its height ranging from two seventh (2/7) to three fifth (3/5) of the total height of the shoe (5). By controlling number, angle, size and position of the conical tapered surface (13, 18), various shoes (5) of different heights can be made of material of same volume.

A generatrix (22) of the conical tapered surface (13, 18) inclines by an angle (θ) of 10 to 30 degrees relative to a central axis of the shoe (5) at a connection (20) between the spherical surface (10) of the convex surface (11) and the conical tapered surface (13, 18)

The bottom surface (12) comprises a flat surface (16) formed substantially at the center thereof, and an annular surface (17) formed between the rounded edge (14) and periphery **(16*a*) of the flat surface (16) concentrically with the flat surface (16). The rounded edge (14) is vertically away of the convex surface (11) from the flat surface (16) by a distance (δ). The flat surface (16) forms a tangent plane to the annular surface (17) at the periphery (16*a*). An inner periphery of the annular surface (17) is continuously and smoothly connected with the flat surface (16) at the periphery (16*a*) of the flat surface (16). An outer periphery of the annular surface (17) is continuously and smoothly connected with the rounded edge (14). The annular surface (17) is formed with a tapered flat surface or spherical surface of a large radius (r) of curvature. The annular surface (17) formed between the rounded edge (14) and flat surface (16) provides a wedge gap (17*a*) which facilitates intrusion of lubricant oil between the bottom surface (12) and flat surface (8) of the swash plate (4) during operation of the compressor. Thus, necessary amount of lubricant oil can be harmoniously applied between the shoe (5) and swash plate (4) even under a severe sliding condition to form oil films on sliding surfaces of the shoe (5) and swash plate (4)**, avoiding the direct contact between the sliding portions which would cause seizure, adhesion and abrasion to improve a sliding property.

The flat surface (16) has its diameter ($d_1$) ranging 12 to 79%, preferably 20 to 70% of the diameter ($d_0$) of the bottom surface (12). The radius (r) of curvature of the annular surface (17) is equivalent to or more than 35 times, preferably equivalent to or more than 100 times of the diameter ($d_0$) of the bottom surface (12). The diameter ($d_0$) of the bottom surface is 750 to 7500 times, preferably 1900 to 4600 times of the distance (δ) between the rounded edge (14) and flat surface (16).

The above-mentioned as well as other objects of the present invention will become apparent during the course of the following detailed description and appended claims.

DETAILED DESCRIPTION OF THE INVENTION

Figure 1:
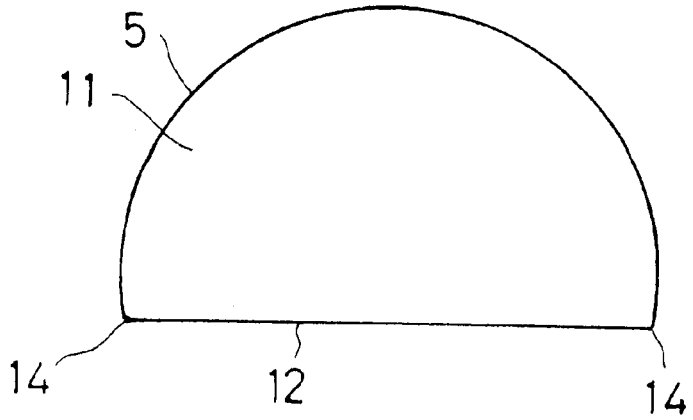
FIG. 1 is a front view of a first embodiment of the shoe for swash plate compressor according to the present invention.
Figure 2:
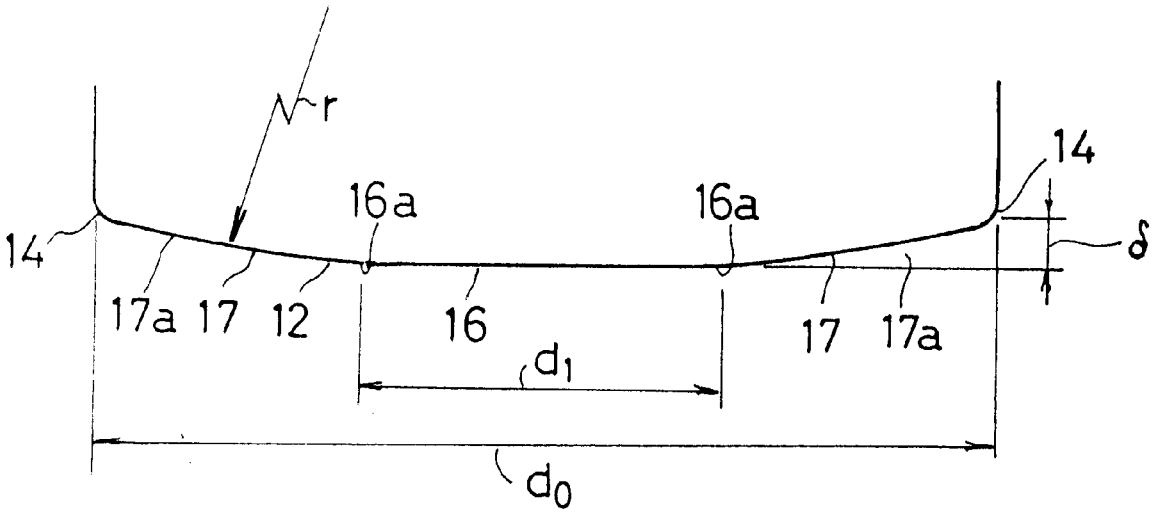
FIG. 2 is an enlarged view of a bottom surface of the shoe shown in FIG. 1.

FIGS. 1 to 9 represent the shoes for a swash plate compressor according to the present invention wherein same symbols are used in FIGS. 1 to 9 to indicate similar parts as those shown in FIGS. 10 to 13.

The shoe 5 according to the present invention includes a rounded edge 14 formed at a boundary between the convex surface 11 and bottom surface 12. This bottom surface 12 comprises a flat surface 16 formed substantially at the center thereof, and an annular surface 17 formed between the rounded edge 14 and periphery 16*a* of the flat surface 16 concentrically with the flat surface 16. The annular surface 17 is formed with a tapered flat surface or spherical surface of a large radius r of curvature. The rounded edge 14 is vertically away of the convex surface 11 from the flat surface 16 by a distance δ. The flat surface 16 forms a tangent plane to the annular surface 17 at the periphery 16*a* so that an inner periphery of the annular surface 17 is continuously and smoothly connected with the flat surface 16 at the periphery 16*a* of the flat surface 16. An outer periphery of the annular surface 17 is continuously and smoothly connected with the rounded edge 14 because an outlined circle in section of the rounded edge 14 inscribes an outlined circle in section of the annular surface 17 or the tapered flat surface of the annular surface 17 is tangent to or in connection by continuous arc or arcs with the outlined circle in section of the rounded edge 14.

The flat surface 16 has its diameter $d_1$, ranging 12 to 79%, preferably 20 to 70% of the diameter $d_0$ of the bottom surface 12. The radius r of curvature of the annular surface 17 surface is equivalent to or more than 35 times, preferably equivalent to or more than 100 times of the diameter $d_0$ of the bottom surface 12. The diameter $d_0$ of the bottom surface is 750 to 7500 times, preferably 1900 to 4600 times of the distance δ between the rounded edge 14 and flat surface 16.

Figure 3:
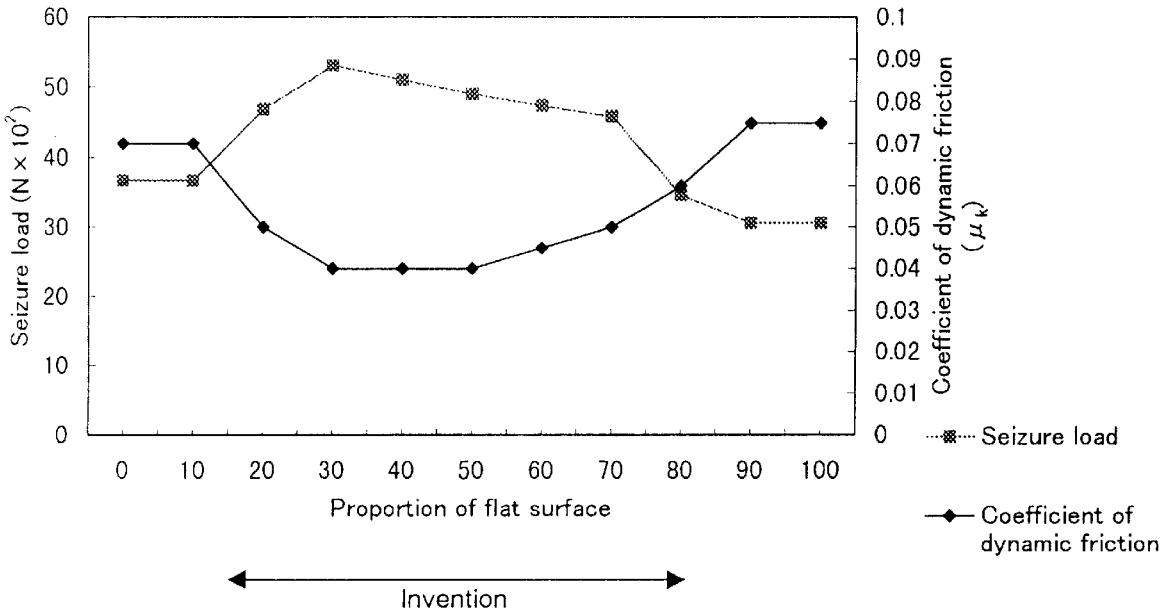
FIG. 3 is a graph showing a test result of seizure loads and coefficients of dynamic friction.

Several samples of the shoes 5 were made according to the present invention and simultaneously reference samples of prior art shoes were made, however, each flat surface of the reference samples had its diameter out of 12 to 79% of their bottom surface's diameter. A test was performed to measure seizure loads and coefficients of dynamic friction of these samples. FIG. 3 and the following table indicate the test result.

| Sample | Proportion (%) of flat surface | Seizure Load (N) | Coefficient ($\mu_k$) of Dynamic Friction |
|---|---|---|---|
| Prior Art Sample 1 | 100 | 30.59 | 0.075 |
| Reference Sample | 90 | 30.59 | 0.075 |
| Reference Sample | 80 | 34.67 | 0.06 |
| Invention's Sample | 70 | 45.89 | 0.05 |
| Invention's Sample | 50 | 48.95 | 0.04 |
| Invention's Sample | 30 | 53.03 | 0.04 |
| Invention's Sample | 20 | 46.91 | 0.05 |
| Reference Sample | 10 | 36.71 | 0.07 |
| Prior Art Sample 2 | 0 | 36.71 | 0.07 |

The test machine included a swash plate 4 of aluminum alloy A 390 (by Standards of Aluminum Association) which is the same material as that of an actual swash plate, and the swash plate 4 was rotated together with the shaft 3 by a power source not shown. The shoes were sandwiched by the swash plate 4 and a support plate (not shown) which was axially slidably mounted on a shaft in parallel to the shaft 3 to apply even load to opposite side of the shoes. Load cells were provided to detect frictional force that pulled the support plate during rotation of the shaft 3. A drop of lubricant oil at a temperature of 80° C. was applied per second to the swash plate 4. The test utilized shoes with the flat surface 16 of different proportions (%) to the bottom surface. Prior Art Samples 1 and 2 are the shoes shown in Japanese Patent Publication Nos. 3-51912 and 63-27554.

As a result of the test, the present invention's samples represent high seizure loads over 40.00N (Newton) that produces adhesion with lower coefficients($\mu_k$) of dynamic friction equal to or less than 0.05 for good sliding property. In the Prior Art Sample 1 formed only with a flat surface on the bottom, adhesion started with seizure load of 30.59N, whereas, in the invention's samples, adhesion started with higher seizure load of 45.89N to 53.03N due to existence of the annular surface 17. In the invention's samples, the coefficient of dynamic friction ($\mu_k$-dimensionless) is reduced over 30% in comparing Prior Art Sample 1.

In the invention's samples, the annular surface 17 formed between the rounded edge 14 and flat surface 16 provides a wedge gap 17*a* which facilitates intrusion of lubricant oil between the bottom surface 12 and flat surface 8 of the swash plate 4 during operation of the compressor. Thus, necessary amount of lubricant oil can be harmoniously applied between the shoe 5 and swash plate 4 even under a severe sliding condition to form oil films or coatings on sliding surfaces of the shoe 5 and swash plate 4, avoiding the direct contact between the sliding portions which would cause seizure, adhesion and abrasion to improve a sliding property.

Figure 4:
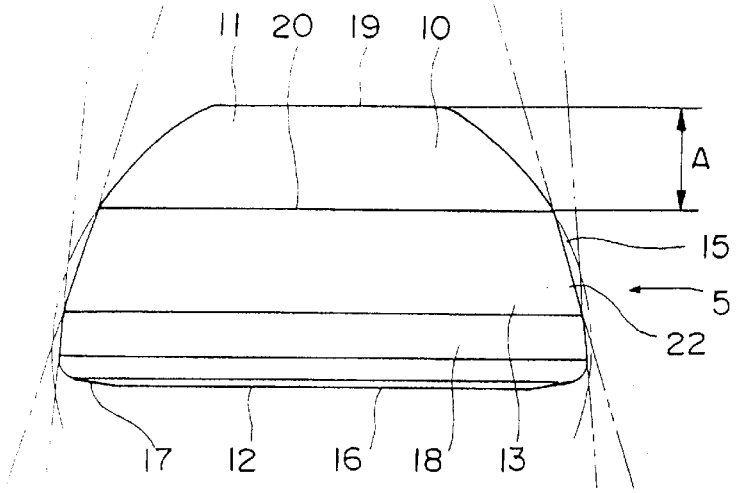
FIG. 4 is a front view of a second embodiment of the shoe according to the present invention.
Figure 5:
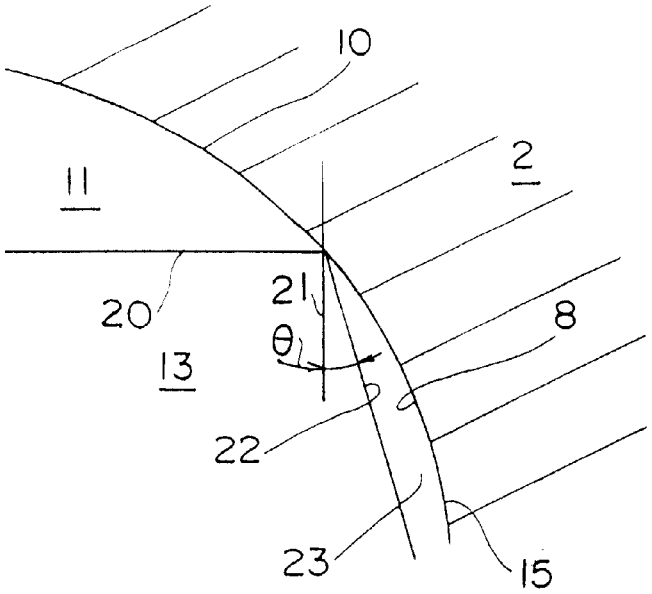
FIG. 5 is an enlarged sectional view showing a sliding portion between the shoe and hemispherical concavity of a piston shown in FIG. 4.

FIGS. 4 to 8 indicate other embodiments of shoes for swash plate compressors according to the present invention. FIG. 4 exhibits a second embodiment of the shoe 5 which includes a convex surface 11 in contact to a hemispherical concavity 7 formed on the piston 2 of the swash plate compressor, and a bottom surface 12 in sliding contact to a surface of a swash plate 4 of the swash plate compressor to convert rotational motion of the swash plate 4 into reciprocal motion of the piston 2. The convex surface 11 comprises a spherical surface 10 extending from a top of the convex surface 11 into the rounded edge 14 formed from a top of a convex surface 11 toward a rounded edge 14, and conical tapered surfaces 13, 18 formed with a same angle or different angles between the spherical surface 10 and the rounded edge 14 to converge toward the spherical surface 10 inside an imaginary spherical surface 15 including the spherical surface 10.

Figure 6:
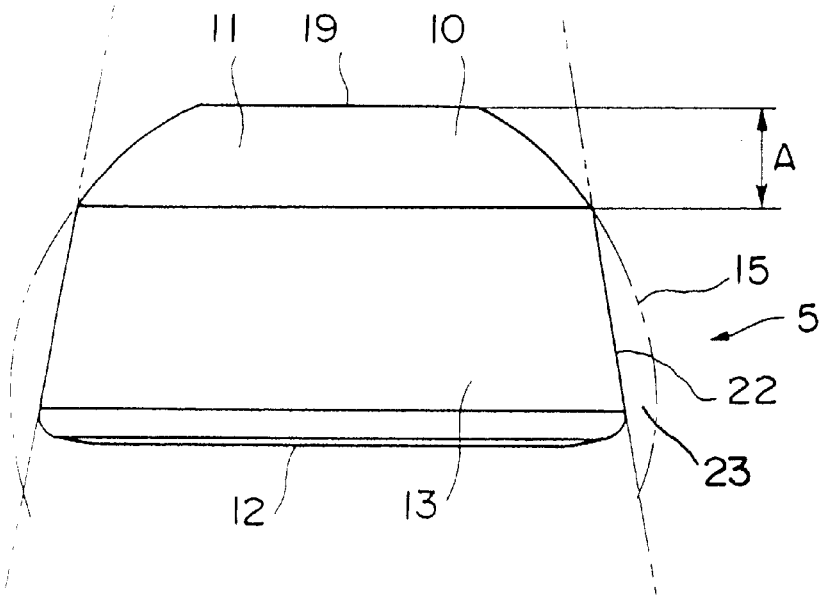
FIG. 6 is a front view of a third embodiment of the shoe according to the present invention.
Figure 7:
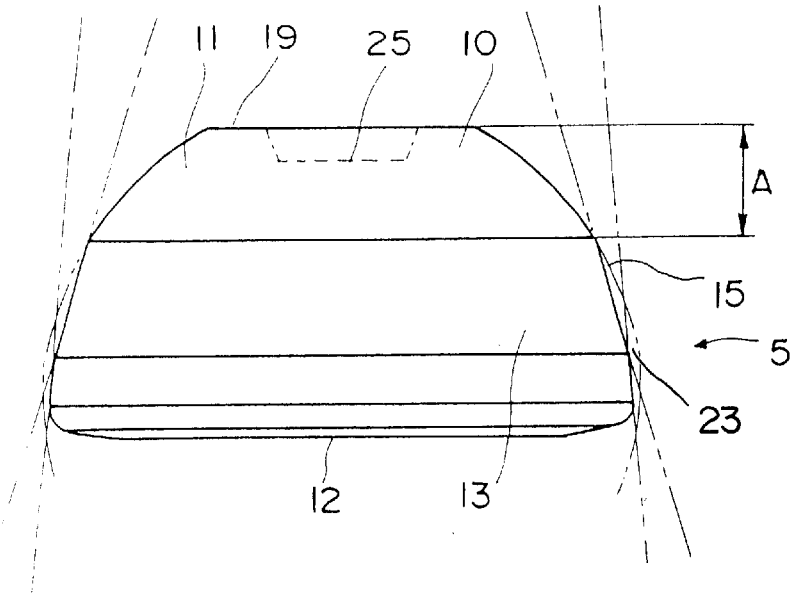
FIG. 7 is a front view of a fourth embodiment of the shoe according to the present invention.

As shown in FIGS. 6 and 7, the conical tapered surfaces 13, 18 which are positioned inside an imaginary spherical surface 15 forms a relatively large arcuate gap 23 between the hemispherical concavity 7 and the conical tapered surfaces 13, 18. Not shown in FIGS. 6 and 7, but the bottom surface 12 is provided with a flat surface 16 at the central portion and an annular surface 17 formed between the rounded edge 14 and flat surface 16 to form a wedge gap 17*a*. The arcuate gap 23 serves to reserve necessary amount of lubricant oil which may be supplied to sliding portions between the spherical surface 10 of the convex surface 11 and hemispherical concavity 7 of the piston 2. In addition, upon manufacture of the shoe 5, it can easily be removed from upper and lower metallic molds 51, 52 due to existence of the arcuate gap 23 which prevents tight fit of the shoe 5 in the upper and lower molds 51, 52.

In an embodiment of the present invention, two or more of the conical tapered surface 13, 18 of different conic angles may be formed between the convex surface 11 and the rounded edge 14. The convex surface 11 may be provided with a flat surface 19 or a hole 25 to reserve therein lubricant oil to be supplied to friction portions between the hemispherical concavity 7 of the piston 2 and shoe 5. The spherical surface 10 formed on the convex surface 11 has its height ranging from two seventh (2/7) to three fifth (3/5) of the total height of the shoe 5. When the spherical surface 10 has its height up to two seventh (2/7) of the total height of the shoe 5, the hemispherical concavity 7 is eroded by the spherical surface 10 to produce backlash between the piston 2 and shoe 5. When the spherical surface 10 has its height over three fifth (3/5), the arcuate gap 23 become too small in volume.

A generatrix 22 of the conical tapered surfaces 13, 18 inclines by an angle θ of 10 to 30 degrees relative to a central axis of the shoe at a connection 20 between the spherical surface 10 of the convex surface 11 and the conical tapered surfaces 13, 18

For example, FIG. 4 indicates the shoe 5 having the first conical tapered surface 13 and the second conical tapered surface 18 adjacent thereto, however, FIG. 6 shows the simple conical tapered surface 13 and more than three (3) conical tapered surfaces may be formed.

Figure 8:
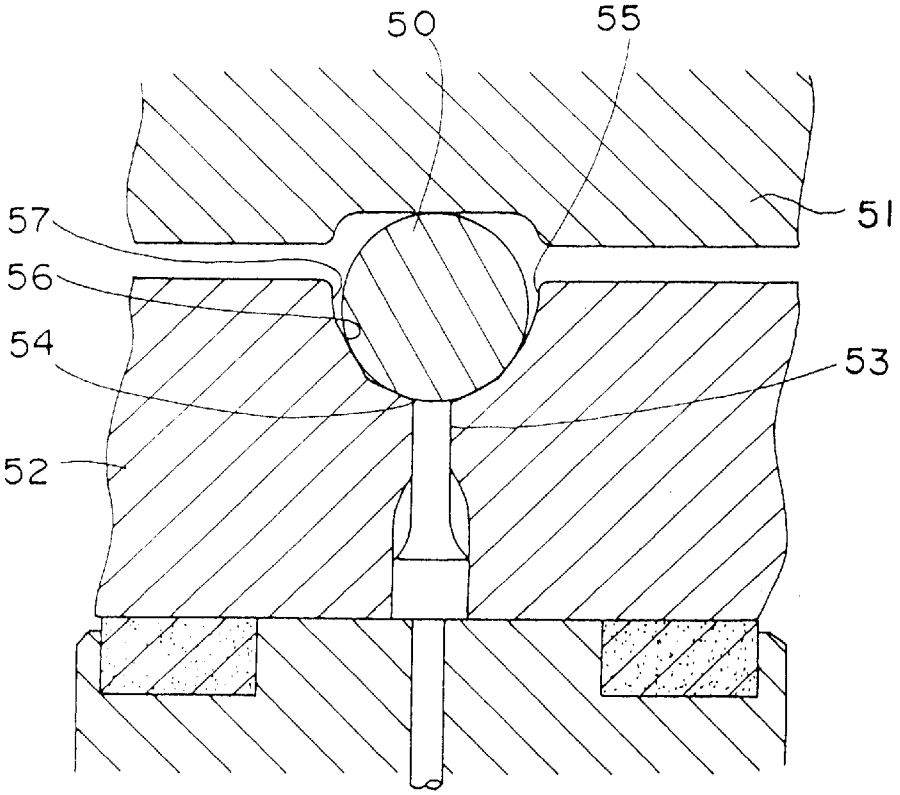
FIG. 8 is a sectional view of a forging die with material to be forged.
Figure 9:
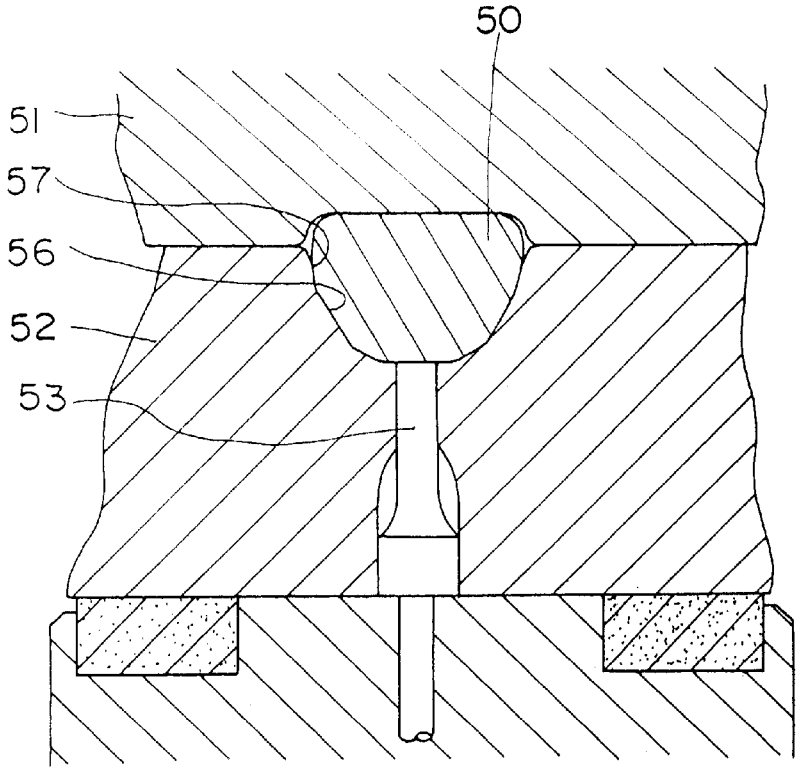
FIG. 9 is a sectional view of the forging die after forging.
Figure 10:
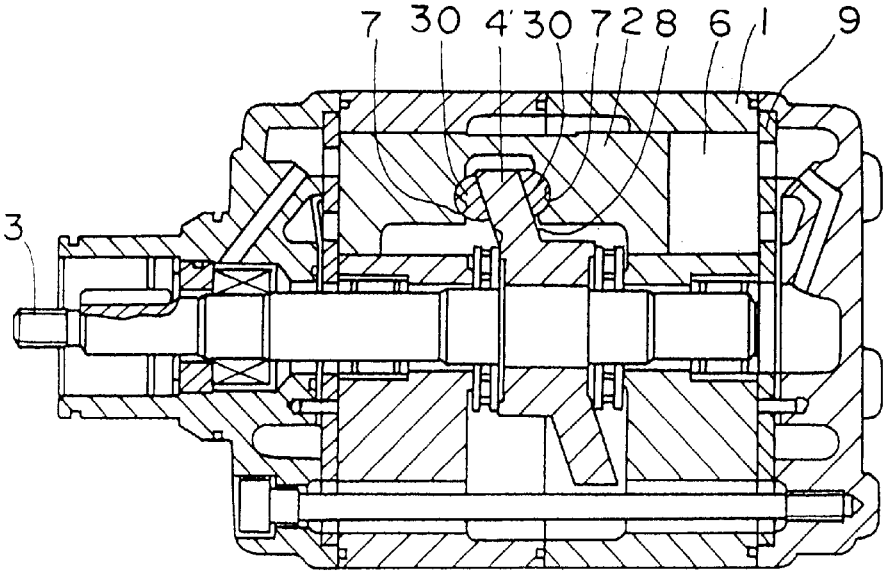
FIG. 10 PRIOR ART
FIG. 10 is a sectional view of a swash plate compressor.
Figure 11:
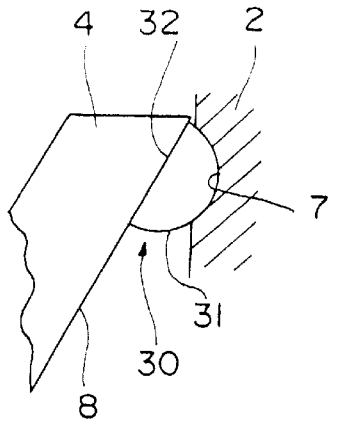
FIG. 11 PRIOR ART
FIG. 11 is a sectional view showing a prior art shoe for a swash plate compressor.
Figure 12:
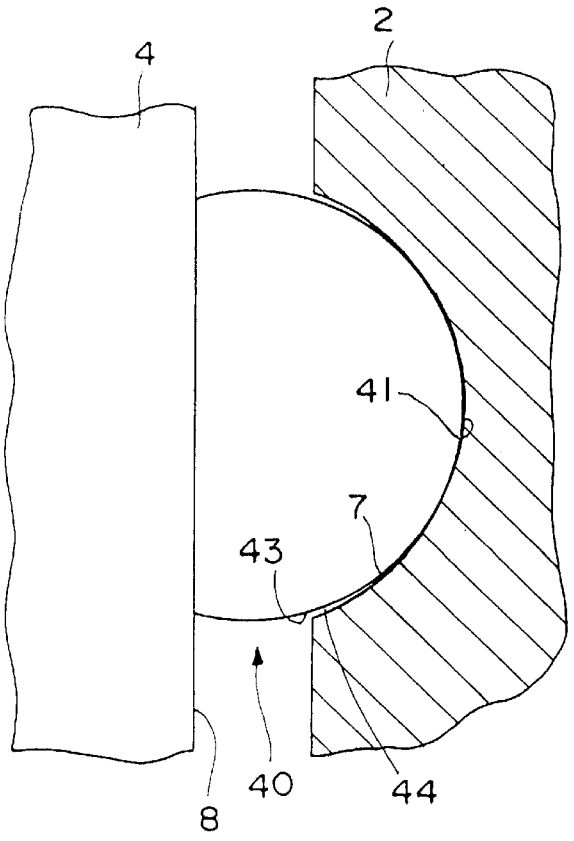
FIG. 12 PRIOR ART
FIG. 12 is a sectional view showing a prior art shoe of another type for a swash plate compressor.
Figure 13:
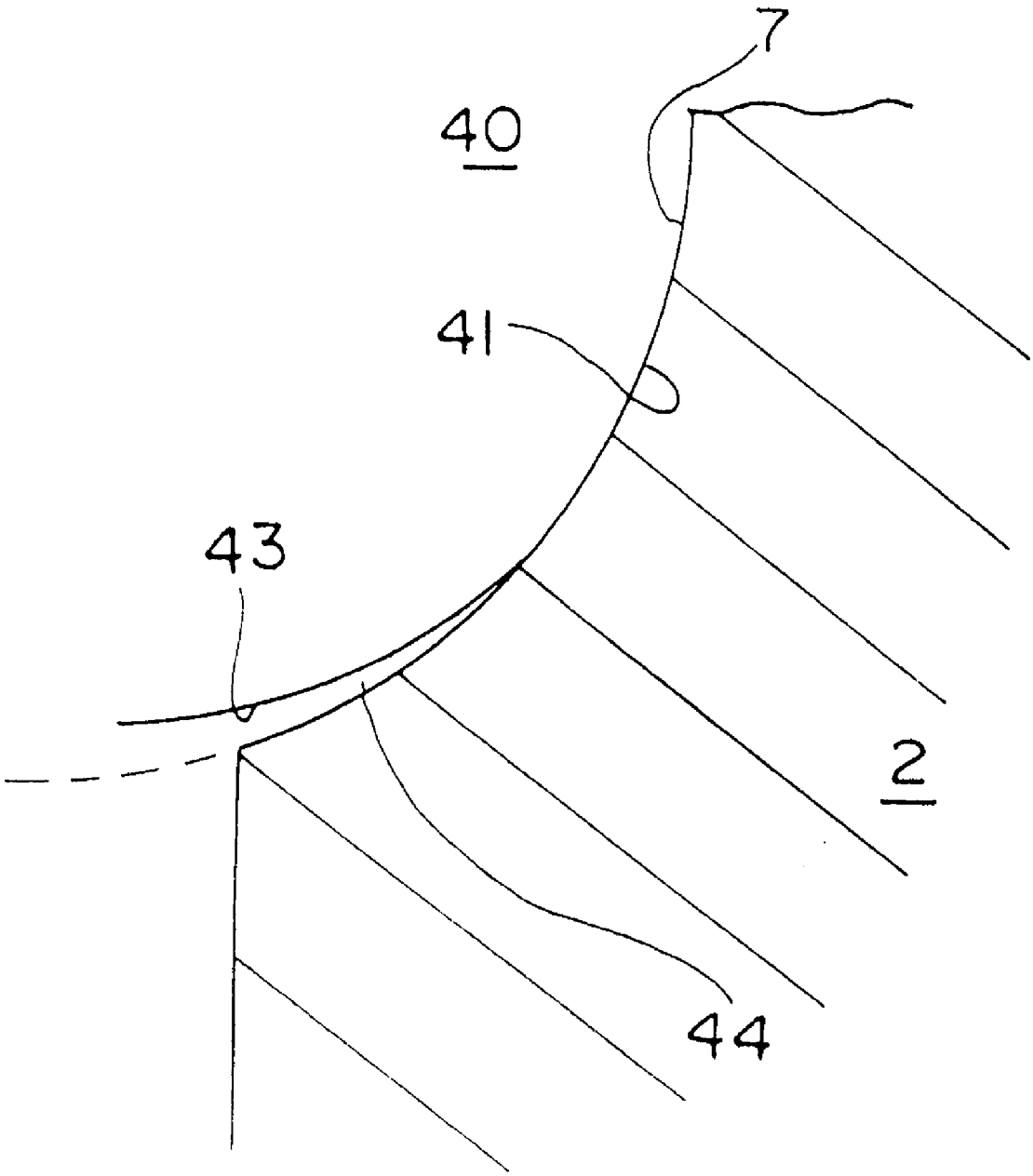
FIG. 13 PRIOR ART
FIG. 13 is a partially enlarged view of FIG. 12.

The shoe 5 shown in FIG. 4 can be formed by known cold forging method as shown by Japanese Patent Publication No.7-24913. FIG. 8 illustrates a first condition before a compression stroke of cold forging. As shown in FIG. 8, annealed ball material 50 to be forged is disposed in a die recess 55 of the lower stationary mold 52 which is formed with two tapered surfaces corresponding to the first and second conical tapered surfaces 13 and 18 of the shoe 5. The material 50 is pressed by the upper movable mold 51 lowered as shown in FIG. 9, and then the upper mold 51 is elevated. An ejector pin 53 slidably mounted in the lower mold 52 is extended into the recess 55 to remove the produced shoe 5 from the lower mold 52.

According to the present invention, it is very easy to remove the shoe 5 from the mold 52 with minimum deformation of the shoe 5 by the ejector pin 53 or the mold 52 upon removal since the shoe 52 is formed with the first or second conical tapered surface 13 or 18 which remarkably reduces frictional force to the mold 52. In other words, the ejector pin 53 can operate with very low driving force. On the contrary thereto, the prior art shoe 40 shown in FIG. 12, cannot easily be removed from a mold, because the swerving spherical surface 43 and the basic spherical surface 41 have their large spherical areas in contact to an inner surface of a mold recess, thus resulting in increase of frictional force upon removal of the shoe from the mold. Accordingly, the prior art shoe 40 requires a larger urging force toward its by the ejector pin upon removal of the shoe from the mold. The shoe 5 according to the present invention can be forged under pressing force of substantially same level as that of the prior art shoe 40 at same pressing rate for good forging process.

Moreover, in the instant invention, by controlling number, angle, size and position of the conical tapered surfaces 13, 18, various shoes 5 of different heights can be made of the material of same volume without necessity of various forged materials of different volumes corresponding to various kinds of molds. Accordingly, the manufacturing process of the shoe can be simplified at reduced cost and without troublesome management of various forged materials and molds. Also, in the invention, formation of harmful burr or flash or damage on surfaces of the shoe 5 can be prevented to establish smooth sliding surfaces of the shoe 5 in contact to the hemispherical concavity 7 of the piston 2 and flat surface 8 of the swash plate 4. Formation of the flat surface 19 or hole 25 on the convex surface 11 serves to more easily control the height of the shoe 5 in manufacture.

The shoes 5 shown in FIGS. 4 and 6 can be fabricated from materials of same volume by forging. In the fourth embodiment shown in FIG. 7, the shoe 5 is formed with the first and second conical tapered surfaces 13, 18 with a larger height A of the spherical surface 10 but with a smaller total height of the shoe 5, whereas in the third embodiment shown in FIG. 6, the simple conical tapered surface 13 is formed larger than that of each first and second conical tapered surfaces 13, 18 with a smaller height A of the spherical surface 10 but with a larger total height of the shoe 5. The shoe 5 of FIG. 6 is taller than that of FIG. 4 by 0.25 millimeters in height so that it is possible to form the shoes 5 with the height differences ranked on the order of a few microns from materials of same volume.

Worked mode of this invention is not limited to the foregoing embodiments, and various modifications can be made in the embodiments. For example, the flat surface 19 or hole 25 can be omitted from the convex surface 11. A spherical surface can be formed between a plurality of conical tapered surfaces.

The worked mode of the present invention can produce the following operations:

[1] The wedge gap 17*a* facilitates intrusion of lubricant oil between the bottom surface 12 and flat surface 8 of the swash plate 4 during operation of the compressor.

[2] Necessary amount of lubricant oil can be harmoniously applied between the shoe 5 and swash plate 4 even under a severe sliding condition to form oil films on sliding surfaces of the shoe 5 and swash plate 4, improving the sliding property.

[3] The direct contact between the sliding portions can be avoided to suppress seizure, adhesion and abrasion to improve resistance to seizure load.

[4] Bearing stress between the shoe 5 and swash plate 4 can be lowered, and coefficient of dynamic friction of the lubricant oil can be reduced.

[5] The arcuate gap 23 serves to reserve necessary amount of lubricant oil which may be supplied to sliding portions between the spherical surface 10 of the convex surface 11 and hemispherical concavity 7 of the piston 2.

[6] The shoe 5 can easily be removed from the metallic mold 52 due to existence of the arcuate gap 23 which prevents tight fit of the shoe 5 in the mold 52.

[7] The bearing pressure is very low because of the flat surface 16 and annular surface 17 on the bottom surface 12 without a small summit at the center of the bottom surface 12 so that adhesion of the shoe can be prevented under the severe operating condition.

As mentioned above, the present invention can realize many practical advantages: (1) harmonious supply of lubricant oil to sliding portions during operation of the compressor, (2) improvement in resistance to seizure load, (3) lowering of coefficient of dynamic friction, (4) smooth operation of the compressor for a long service and long duration with easy maintenance, and (5) manufacture of the compressor at lowered cost.

What is claimed are:

1. In a shoe for a swash plate compressor, said shoe including a convex surface and a bottom surface; said convex surface extending from a top of said convex surface into a rounded edge formed at a boundary between said convex surface and bottom surface; said convex surface being in contact to a hemispherical concavity formed on a piston of said swash plate compressor; and said bottom surface being in sliding contact to a surface of a swash plate of said swash plate compressor to convert rotational motion of said swash plate into reciprocal motion of said piston; the improvement comprising:

said convex surface comprising a spherical surface and at least a conical tapered surface, said conical tapered surface being formed between said spherical surface and said rounded edge to converge toward said spherical surface inside an imaginary spherical surface including said spherical surface, said bottom surface comprising a flat surface formed substantially at the center thereof, and an annular surface formed between said rounded edge and periphery of said flat surface concentrically with said flat surface;

said rounded edge being vertically away from said flat surface by a distance ($\delta$);

an inner periphery of said annular surface being continuously and smoothly connected with said flat surface at said periphery of said flat surface, an outer periphery of said annular surface being continuously and smoothly connected with said rounded edge; and said annular surface being formed with a tapered flat surface or spherical surface of a large radius (r) of curvature.

2. The shoe of claim 1, wherein two or more of said conical tapered surface of different conical angles are formed between said convex surface and said rounded edge.

3. The shoe of claim 1, wherein said spherical surface formed on said convex surface has its height ranging from two seventh (2/7) to three fifth (3/5) of the total height of said shoe.

4. The shoe of claim 1, wherein a generatrix of said conical tapered surface inclines by an angle ($\theta$) of 10 to 30 degrees relative to a central axis of the shoe at a connection between said spherical surface of said convex surface and said conical tapered surface.

5. The shoe of claim 1, wherein said flat surface has its diameter ($d_1$) ranging 12 to 79% of the diameter ($d_0$) of said bottom surface.

6. The shoe of claim 5, wherein said flat surface has its diameter (d*1*) ranging 20 to 70% of the diameter ($d_0$) of said bottom surface.

7. The shoe of claim 1, wherein said radius (r) of curvature of said annular surface is equivalent to or more than 35 times of the diameter ($d_0$) of said bottom surface.

8. The shoe of claim 7, wherein said radius (r) of curvature of said annular surface is equivalent to or more than 100 times of the diameter ($d_0$) of said bottom surface.

9. The shoe of claim 1, wherein the diameter ($d_0$) of said bottom surface is 750 to 7500 times of the distance ($\delta$) between said rounded edge and flat surface.

10. The shoe of claim 9, wherein the diameter ($d_0$) of said bottom surface is 1900 to 4600 times of the distance ($\delta$) between said rounded edge and flat surface.

11. The shoe of claim 1, wherein said flat surface forms a tangent plane to said annular surface at said periphery.

* * * * *